United States Patent [19]

Satake et al.

[11] Patent Number: 4,630,080

[45] **Date of Patent: * Dec. 16, 1986**

[54] HEAT-SENSITIVE RECORDING SHEET

[75] Inventors: Toshimi Satake; Yoshihide Kimura; Toshiaki Minami; Fumio Fujimura, all of Tokyo, Japan

[73] Assignee: Jujo Paper Co., Ltd., Tokyo, Japan

[ * ] Notice: The portion of the term of this patent subsequent to May 20, 2003 has been disclaimed.

[21] Appl. No.: 795,991

[22] Filed: Nov. 6, 1985

[30] Foreign Application Priority Data

Nov. 16, 1984 [JP] Japan ..... 59-242142
Dec. 20, 1984 [JP] Japan ..... 59-269542

[51] Int. Cl.[4] ..... B41M 5/18

[52] U.S. Cl. ..... 346/209; 346/216; 346/217; 346/225; 427/150

[58] Field of Search ..... 346/208, 209, 216, 217, 346/221, 225, 220, 221, 224; 427/150, 151, 152

[56] References Cited

U.S. PATENT DOCUMENTS 4,536,779 8/1985 Nachbur et al. ..... 346/216
4,568,766 2/1986 Yahagi et al. ..... 346/216

FOREIGN PATENT DOCUMENTS 0137982 4/1985 European Pat. Off. ..... 346/209
0166098 10/1983 Japan ..... 346/216
2142630A 1/1985 United Kingdom ..... 346/216

*Primary Examiner*—Bruce H. Hess
*Attorney, Agent, or Firm*—Koda and Androlia

[57] ABSTRACT

A heat-sensitive recording sheet comprising both calcium monobenzyl phthalate as stabilizer and 4-isopropoxy-4'-hydroxy diphenylsulfone and/or 4-methyl-4'-hydroxy diphenylsulfone as organic developer in heat-sensitive layer which comprises a basic colorless dyestuff and an organic developer. This heat-sensitive recording sheet provides the improved stability of developed color image against sticking of hair tonics and oils, etc.

7 Claims, No Drawings

HEAT-SENSITIVE RECORDING SHEET

BACKGROUND OF THE INVENTION

1. Field of the Invention

This invention relates to a heat-sensitive recording sheet having excellent oil resistance and preservation stability.

2. Prior Art

Heat-sensitive recording sheets utilizing the color development reaction of a so-called basic colorless dyestuff which is in general colorless or light color with an organic color-developer such as phenols and organic acids by heating are disclosed in Japanese Patent Publication Nos. 4160/1968 and 14039/1970, Japanese Laid-Open Patent Application Nos. 277361/1973 and the like, and these heat-sensitive recording sheets have been widely applied for practical use.

Generally, a heat-sensitive recording sheet is produced by applying on the substrat, such as paper and film, the coating which is prepared by individually grinding and dispersing a basic colorless dyestuff and an organic color-developer into fine particles, mixing the resultant dispersion with each other and then adding thereto binder, filler, sensitizer, slipping agent and other auxiliaries. When this sheet is heated, the coating undergoes instantaneously a chemical reaction which develops a color. In this case various bright colors can be advantageously formed depending upon selection of specific colorless dyestuff.

These heat-sensitive recording sheets have now been applied in wide range of fields, such as recorders for measurement in the medical field or industrial field, terminal printer of computers and information communication systems, printers of electric desk computers, automatic ticket vending machine and the like. The heat-sensitive recording papers afford a clear records of high density, cause no troubles such as adhesion of refuse to the thermal head and sticking, and possess excellent recording property, but, on the other hand, the improvement of their basic qualities, such as less color development of ground color with the passage of time, has been required.

The present applicants already revealed that a heat-sensitive recording paper using 4-isopropoxy-4'-hydroxy diphenylsulfone or 4-methyl-4'-hydroxy diphenylsulfone as a developer is quite excellent in the basic qualities described above in Japanese Patent Application No. 175374/1984 or 96691/1984.

Meanwhile, heat-sensitive recording papers are inevitably touched with the hands of man, in view of their function as papers to record information. As the fingers of the operator are often adhered by oily substances such as his hair tonic daily used and oils contained in the sweat on his skin, it may safely be said that the heat-sensitive recording papers are most frequently contaminated by such oily substances. In general, the heat-sensitive recording papers have insufficient stability against these oily substances, so that the density of the developed color image on the contaminated part is often reduced or disappeared. Also, the phenomenon of discoloration of the contaminated white ground is observed. Their causes can not be sufficiently elucidated yet, but it is supposed that the oily substances partly dissolve the coloring layer consisting of the fine granular basic colorless dyestuff and organic developer or coloring reactant thereof, or make the coloring layer or coloring reactant thereof unstable.

As described above, the heat-sensitive recording paper containing 4-isopropoxy-4'-hydroxy diphenylsulfone or 4-methyl-4'-hydroxy diphenylsulfone as the developer has excellent basic qualities, while its stability against the oily substances was found to be slightly poor, compared with bisphenol-type developers generally used conventionally.

As to the bisphenol-type developer, Japanese Patent Application OPI No. 6795/1982 proposes a method to improve preservation stability such as plasticizer resistance by using a metal salt of aliphatic carboxylic acids or a metal salt of aromatic carboxylic acids together with the developer. However, the combination of the metal salts of these carboxylic acids with the heat-sensitive recording paper containing 4-isopropoxy-4'-hydroxy diphenylsulfone or 4-methyl-4'-hydroxy diphenylsulfone as the developer hardly improve the stability against the oily substances, and the reduction of preservation stability of ground color and developed images was instead observed.

SUMMARY OF THE INVENTION

An object of the present invention is to provide a heat-sensitive recording sheet which uses 4-isopropoxy-4'-hydroxy diphenylsulfone or 4-methyl-4'-hydroxy diphenylsulfone as the organic developer, and has the improved stability of developed color image against sticking of hair tonics and oils and the superior stability of ground color under the conditions of high temperature and high humidity, without losing the excellent basic qualities, particularly the stability of ground color.

The above object may be performed by using calcium monobenzyl phthalate represented by the following general formula (III) together as the stabilizer against 4-isopropoxy-4'-hydroxy diphenylsulfone and/or 4-methyl-4'-hydroxy diphenylsulfone represented by the following general formula (I) or (II).

(I)

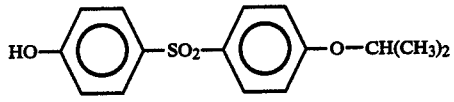

(II)

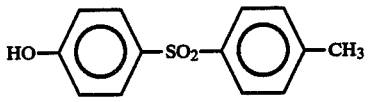

(III)

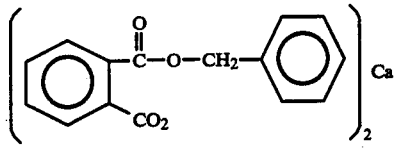

DETAILED DESCRIPTION OF THE INVENTION

In using 4-methyl-4'-hydroxy diphenylsulfone represented by the general formula (II), zinc monobenzyl phthalate provides a heat-sensitive recording sheet having the same effects as those of the present invention. 4-isopropoxy-4'-hydroxy diphenylsulfone as the organic developer used in the present invention is a compound having a melting point of 129° to 130° C. And 4-methyl-4'-hydroxy diphenylsulfone as the organic developer used in the present invention is a compound having a melting point of 130° to 145° C.

Calcium monobenzylphthalate is a colorless substance having a high melting point (mp 250° C. or more) which can be obtained by the reaction of sodium salt of monobenzylphthalate with calcium chloride.

The above stabilizer used in this invention is a compound having a specific molecular structure which is selected from metal salts of many organic carboxylic acids. Such stabilizer is preferably added in an amount ranging from 10 to 60 wt.% against the organic developer. Less than 10 wt % is too small to give sufficient effect, and more than 60 wt % is apt to cause troubles such as reduction of the developed color density by dilution effect and sticking.

On the other hand, the species of the basic colorless dyestuffs of this invention is not otherwise limited and it is preferable to use triphenylmethan dyestuffs, fluoran dyestuffs, azaphthalide dyestuffs, etc.

Examples of such dyestuffs are as follows.

Triphenylmethane leuco dyes 3,3-bis(p-dimethylaminophenyl)-6-dimethylaminophthalide (crystall violet lactone)

Fluoran leuco dyes 3-diethylamino-6-methyl-7-anilinofluoran
3-(N-ethyl-p-toluidino)-6-methyl-7-anilinofluoran
3-(N-ethyl-N-isoamyl)amino-6-methyl-7-anilinofluoran
3-diethylamino-6-methyl-7-(O,P-dimethylanilino)fluoran
3-pyrolidino-6-methyl-7-anilinofluoran
3-pyperidino-6-methyl-7-anilinofluoran
3-(N-cyclohexyl-N-methylamino)-6-methyl-7-anilinofluoran
3-diethylamino-7-(m-trifluoromethylanilino)fluoran
3-dibutylamino-7-(o-chloroanilino)fluoran
3-diethylamino-6-methyl-chlorofluoran
3-diethylamino-6-methyl-fluoran
3-cyclohexylamino-6-chlorofluoran
3-diethylamino-7-(o-chloroanilino)fluoran
3-diethylamino-benzo[a]-fluoran Azaphthalide leuco dyes 3-(4-diethylamino-2-ethoxyphenyl)-3-(1-ethyl-2-methylindole-3-yl)-4-azaphthalide
3-(4-diethylamino-2-ethoxyphenyl)-3-(1-ethyl-2-methylindole-3-yl)-7-azaphthalide
3-(4-diethylamino-2-ethoxyphenyl)-3-(1-octyl-2-methylindole-3-yl)-4-azaphthalide
3-(4-N-cyclohexyl-N-methylamino-2-methoxyphenyl)-3-(1-ethyl-2-methylindole-3-yl)-4-azaphthalide The above-described dyestuffs may be used either alone or in combination. The solely use of the basic colorless dyestuff, such as 3-diethylamino-6-methyl-7-anilinofluoran, 3-(N-cyclohexyl-N-methylamino)-6-methyl-7-anilinofluoran, 3-(N-ethyl-N-isoamyl)amino-6-methyl-7-anilinofluoran or 3-(4-diethylamino-2-ethoxyphenyl)-3-(1-ethyl-2-methylindole-3-yl)-4-azaphthalide, provides a heat-sensitive recording sheet with a remarkably high dynamic image density.

The combined use of 3-diethylamino-6-methyl-7-anilinofluoran with 3-(n-cyclohexyl-n-methylamino)-6-methyl-7-anilinofluoran provides a heat-sensitive recording sheet having a remarkably high dynamic image density, a superior oil-resistance and an improved stability in preserving.

In this case, the sensitizer (e.g. terephthalic acid dibenzyl ester, p-benzoxybenzoic acid benzyl ester, di-p-tolyl carbonate, p-benzylbiphenyl, phenyl α-naphthyl carbonate) may be added thereto. The organic color-developer and the colorless basic dyestuff, as well as the stabilizer as mentioned above are finely pulverized in a grinder such as ball mill, an attritor, a sand grinder or the like, or in an appropriate emulsifying apparatus into fine particles of less than several micron particle size and incorporated with various type of additives depending on the purposes to prepare a coating solution. Other color developers may be added in an amount which does not deteriorate the effects of the present invention. The coating solution may usually be incorporated with binders such as polyvinyl alcohol, modified polyvinyl alcohol, hydroxyethylcellulose, methylcellulose, starches, styrene-maleic anhydride copolymer, vinylacetate-maleic anhydride copolymer and styrenebutadiene copolymer, as well as organic or inorganic filler such as kaolin, calcined kaolin, diatomaceous earth, talc, titanium oxide, calcium carbonate, magnesium carbonate and aluminum hydroxide. In addition, releasing agent such as metal salt of fatty acid, lubricant such as waxes, UV-absorber of benzophenone or triazole type, water-proofing agent such as glyoxal, dispersant, defoamer, mottoling preventing agent (e.g. fatty acid amide, ethylene bisamide, montan wax, polyethylene wax), stabilizer (e.g. metal salt of phthalic acid monoester, metal p-tert-butylbenzoate, metal nitrobenzoate) or the like can also be used. By coating the solution on sheet such as paper or various types of films, aimed heat-sensitive recording sheets can be obtained.

The amount of organic color-developer, basic colorless dyestuff, stabilizer, as well as the kind and the amount of various other ingredients used in this invention are determined depending on the required performances and the recording properties with no particular restriction. However, in the use of 4-isopropoxy-4'-hydroxy diphenylsulfone as organic developer, it is usually appropriate to employ 3–12 parts of 4-isopropoxy-4'-hydroxy diphenylsulfone, 1–4 parts of the stabilizer of this invention and 1–20 parts of the filler per one part of the colorless basic dye, and 10–25 parts of the binder for the total solid content.

In the use of 4-methyl-4'-hydroxy diphenylsulfone as organic developer, it is usually appropriate to employ 3–12 parts of 4-methyl-4'-hydroxy diphenylsulfone, 3–12 parts of the stabilizer of this invention and 1–20 parts of the filler per one part of the colorless basic dye, and 10–25 parts of the binder for the total solid content.

By coating the solution on sheet such as paper or various types of films, aimed heat-sensitive recording sheet can be obtained.

It is not sure why the aforementioned effects are obtained by the combined use of the organic developer of the present invention, 4-isopropoxy-4'-hydroxy diphenylsulfone and/or 4 methyl-4'-hydroxy diphenylsulfone, and the stabilizer of this invention, calcium monobenzyl phthalate. However, calcium monobenzyl phthalate, which being a calcium salt having a voluminous benzyl group as a hydrophobic group in the molecule, keeps the moderate balance of the hydrophobic property and hydrophobic property. Therefore, when the organic color-developer 4-isopropoxy-4'-hydroxy diphenylsulfone and/or 4-methyl-4'-hydroxy diphenylsulfone, leuco dye and calcium monobenzyl phthalate undergo a physicochemical reaction by the application of heat and a coloring composition is formed, the coloring composition becomes nonsoluble to oil and the maintenance of the ground color is improved, whereby the effects of this invention will be obtained.

EFFECTS OF THE INVENTION

The effects of this invention are as follows:

(1) Colored images are stable to the sticking of hair oils and fats and oils.

(2) Ground color is stable under the conditions of high temperature and humidity.

The present invention will be described by way of examples hereunder. Throughout the specification the parts are units by weight.

EXAMPLE 1

| | |
|---|---|
| A liquid (dye dispersion) | |
| 3-diethylamino-6-methyl-7-anilinofluorane | 2.0 parts |
| 10% polyvinyl alcohol aqueous solution | 4.6 parts |
| Water | 2.5 parts |
| B liquid (organic developer dispersion) | |
| 4-isopropoxy-4'-hydroxydiphenylsulfone | 6 parts |
| 10% polyvinyl alcohol aqueous solution | 29.5 parts |
| Water | 5.5 parts |
| C liquid (stabilizer dispersion) | |
| Calcium monobenzyl phthalate | 2 parts |
| 10% polyvinyl alcohol aqueous solution | 2.5 parts |
| Water | 1.5 parts |

Each of the solutions having the above-composition was ground by an attritor into particle size of 3 μm.

Then, the dispersions were mixed in the ratio described below to prepare a coating solution.

| | |
|---|---|
| Solution A (dye dispersion) | 9.1 parts |
| Solution B (developer dispersion) | 41 parts |
| Solution C (sensitizer dispersion) | 6 parts |
| Kaolin clay (50% dispersion) | 20 parts |

The coating solution as described above was coated and dried on one surface of a base paper of 50 g/m$^2$ so as to obtain about 6.0 g/m$^2$ of the coating amount. The coated papers were treated by a supercalendar so as to obtain a smoothness of 200–600 seconds. The quality performance test was carried out for the thus obtained heat sensitive recording paper and the results are shown in Table 1.

COMPARATIVE EXAMPLE 1

Heat sensitive recording paper was prepared in the same manner as in Example 1 without using the solution C as used in Example 1. The results of the quality performance test are shown in Table 1.

COMPARATIVE EXAMPLES 2–5

| Solution D (stabilizer dispersion) | |
|---|---|
| Stabilizer (refer to Table 1) | 2 parts |
| 10% aqueous solution of polyvinyl alcohol | 2.5 parts |
| Water | 1.5 parts |

Heat sensitive recording paper was prepared in the same manner as in Example 1 except for using the solution D processed in the attritor in place of the solution C. The results for the quality performance test are shown in Table 1.

COMPARATIVE EXAMPLE 6

| | |
|---|---|
| Solution A (dye dispersion) | |
| 3-diethylamino-6-methyl-7-anilinofluorane | 2.0 parts |
| 10% aqueous solution of polyvinyl alcohol | 4.6 parts |
| Water | 2.5 parts |
| Solution E (developer dispersion) | |
| Bisphenol A | 6 parts |
| 10% aqueous solution of polyvinyl alcohol | 29.5 parts |
| Water | 5.5 parts |
| Solution C (stabilizer dispersion) | |
| Calcium monobenzyl phthalate | 2 parts |
| 10% aqueous solution of polyvinyl alcohol | 2.5 parts |
| Water | 1.5 parts |

Each of the solutions having the above-composition was ground by an attritor into particle size of 3 μm.

Then the dispersions were mixed in the ratio described below to prepare a coating solution.

| | |
|---|---|
| Solution A (dye dispersion) | 9.1 parts |
| Solution E (developer dispersion) | 41 parts |
| Solution C (stabilizer dispersion) | 6 parts |
| Kaolin clay (50% dispersion) | 20 parts |

The coating solution as described above was coated and dried on one surface of a substrate paper of 50 g/m$^2$ so as to obtain about 6.0 g/m$^2$ of the coating amount. The coated paper sheets were processed in a supercalendar so as to obtain a smoothness of 200–600 seconds. The quality performance test was carried out for the thus obtained heat sensitive recording paper and the results are shown in Table 1.

COMPARATIVE EXAMPLE 7

Heat sensitive recording paper was prepared in the same manner as in Comparative Example 6 without using the solution C as used in Comparative Example 6. The results of the quality performance test are shown in Table 1.

COMPARATIVE EXAMPLES 8–11

Heat sensitive recording paper was prepared in the same manner as in comparative Example 6 except for using the solution D treated by the attritor in place of the solution C. The results for the quality performance test are shown in Table 1.

COMPARATIVE EXAMPLE 12

| | |
|---|---|
| Solution A (dye dispersion) | |
| 3-diethylamino-6-methyl-7-anilinofluorane | 2.0 parts |
| 10% aqueous solution of polyvinyl alcohol | 4.6 parts |
| Water | 2.5 parts |
| Solution F (developer dispersion) | |
| Benzyl p-hydroxybenzoate | 6 parts |
| 10% aqueous solution of polyvinyl alcohol | 29.5 parts |
| Water | 5.5 parts |
| Solution C (stabilizer dispersion) | |
| Calcium monobenzyl phthalate | 2 parts |
| 10% aqueous solution of polyvinyl alcohol | 2.5 parts |
| Water | 1.5 parts |

Each of the solutions having the above-composition was ground by an attritor into particle size of 3 μm.

Then, the dispersions were mixed in the ratio described below to prepare a coating solution.

| | |
|---|---|
| Solution A (dye dispersion liquid) | 9.1 parts |
| Solution F (developer dispersion liquid) | 41 parts |
| Solution C (stabilizer dispersion liquid) | 6 parts |
| Kaolin clay (50% dispersion liquid) | 20 parts |

The coating solution as described above was coated and dried on one surface of a base paper of 50 g/m$^2$ so as to obtain the coating of about 6.0 g/m$^2$ amount. The coated papers were processed in a supercalendar so as to obtain a smoothness of 200–600 seconds. The quality performance test was carried out for the thus obtained heat sensitive recording paper and the results are shown in Table 1.

COMPARATIVE EXAMPLE 13

Heat sensitive recording paper was prepared in the same manner as in Comparative Example 12 without using the solution C as used in Comparative Example 12. The results of the quality performance test are shown in Table 1.

COMPARATIVE EXAMPLES 14–17

Heat sensitive recording paper was prepared in the same manner as in Comparative Example 12 except for using the solution D in place of the solution C. The results for the quality performance test are shown in Table 1.

EXAMPLE 2

| | |
|---|---|
| A liquid (dyestuff dispersion) | |
| 3-diethylamino-6-methyl-7-anilnofluorane | 2.0 parts |
| 10% polyvinyl alcohol aqueous solution | 4.6 parts |
| Water | 2.5 parts |
| B liquid (developer dispersion) | |
| 4-methyl-4'-hydroxy diphenylsulfone | 6 parts |
| 10% polyvinyl alcohol aqueous solution | 29.5 parts |
| Water | 5.5 parts |
| C liquid (stabilizer dispersion) | |
| Calcium monobenzyl phthalate | 2 parts |
| 10% polyvinyl alcohol aqueous solution | 2.5 parts |
| Water | 1.5 parts |

Each of the solutions having the above-composition was ground by an attritor into particle size of 3 μm.

Then, the dispersion liquids were mixed in the ratio described below into a coating solution.

| | |
|---|---|
| Solution A (dyestuff dispersion) | 9.1 parts |
| Solution B (developer dispersion) | 41 parts |
| Solution C (sensitizer dispersion) | 6 parts |
| Kaolin clay (50% dispersion) | 20 parts |

The coating solution as described above was coated and dried on one surface of a substrate paper of 50 g/m$^2$ so as to obtain about 6.0 g/m$^2$ of the coating amount. The coated paper sheets were processed in a

TABLE 1

| | | | Test results | | | | | |
|---|---|---|---|---|---|---|---|---|
| | | | Oil resistance (4) | | | White paper preservability | | |
| | Stabilizer | Color developer | Before treatment | After treatment | Residual rate (%) | Untreated | Humidity resistance (6) | Thermal resistance (7) |
| Example 1 | Calcium monobenzyl phthalate | IPHDS (1) | 1.19 | 1.12 | 94.1 | 0.06 | 0.06 | 0.09 |
| Comparative example 1 | No addition | " | 1.20 | 0.18 | 15.0 | 0.06 | 0.06 | 0.08 |
| Comparative examples 2–5 | Zinc stearate | " | 1.19 | 0.17 | 14.3 | 0.07 | 0.07 | 0.08 |
| | Zinc terephthalate | " | 1.19 | 0.18 | 15.1 | 0.07 | 0.09 | 0.12 |
| | Zinc benzoate | " | 1.20 | 0.65 | 54.2 | 0.07 | 0.09 | 0.12 |
| | Zinc-t-butylbenzoate | " | 1.18 | 0.65 | 55.1 | 0.07 | 0.09 | 0.12 |
| Comparative example 6 | Calcium monobenzyl phthalate | BPA (2) | 1.09 | 1.01 | 92.7 | 0.09 | 0.09 | 0.14 |
| Comparative example 7 | No addition | " | 1.10 | 0.33 | 30.0 | 0.08 | 0.09 | 0.10 |
| Comparative examples 8–11 | Zinc stearate | " | 1.10 | 0.22 | 20.0 | 0.08 | 0.08 | 0.18 |
| | Zinc terephthalate | " | 1.08 | 0.23 | 21.3 | 0.09 | 0.11 | 0.20 |
| | Zinc benzoate | " | 1.09 | 0.66 | 60.6 | 0.09 | 0.11 | 0.19 |
| | Zinc-t-butylbenzoate | " | 1.10 | 0.65 | 59.1 | 0.09 | 0.10 | 0.21 |
| Comparative example 12 | Calcium monobenzyl phthalate | PHBB (3) | 1.30 | 1.10 | 84.6 | 0.07 | 0.09 | 0.16 |
| Comparative example 13 | No addition | " | 1.32 | 0.29 | 22.0 | 0.07 | 0.08 | 0.15 |
| Comparative examples 14–17 | Zinc stearate | " | 1.30 | 0.13 | 10.0 | 0.07 | 0.08 | 0.16 |
| | Zinc terephthalate | " | 1.31 | 0.14 | 10.7 | 0.08 | 0.10 | 0.18 |
| | Zinc benzoate | " | 1.29 | 0.52 | 40.3 | 0.08 | 0.09 | 0.17 |
| | Zinc-t-butylbenzoate | " | 1.30 | 0.55 | 42.3 | 0.08 | 0.10 | 0.18 |

Note (1): IPHDS; Representing 4-isopropoxy-4'-hydroxydiphenyl-sulfone.
Note (2): BPA; Representing bisphenol A.
Note (3): PHBB; Representing p-hydroxybenzoic acid benzyl.
Note (4): Oil resistance;
The density of a recorded image with an impressed voltage of 18.03 V and a pulse length of 3.2 milliseconds using the heat-sensitive facsimile KB-4800 made by Toshiba Corp. was measured with a Macbeth densitometer (using a RD-514 amber filter). The density thus measured was adopted as the density before treatment. On the other hand, the density after treatment with oil was measured in the following manner. First, castor oil was dropped in the colored part of printed letters. After 10 seconds, castor oil was lightly wiped up with a filter paper. After permitting to stand for 3 days at room temperature, the density of developed color was measured using the Macbeth densitometer. Residual rate was calculated from the following equation.

$$\text{Residual rate} = \frac{\text{Density of developed color after treatment with oil}}{\text{Density of developed color before treatment}} \times 100\ (\%)$$

Note (5): White paper preservability;
The density of the uncolored part was measured using the Macbeth densitometer.
Note (6): Humidity resistance;
Density of the image after permitting to stand for 24 hours under the circumstances of high humidity (90% RH) at 40° C.
Note (7): Thermal resistance;
Density of the image after permitting to stand for 24 hours under the circumstances of high temperature (60° C.) and dryness.

super calendar so as to obtain a smoothness of 200–600 seconds.

COMPARATIVE EXAMPLE 18

Heat-sensitive recording paper was prepared in the same manner as in Example 2 without using the solution C as used in Example 2.

COMPARATIVE EXAMPLES 19–22

| Solution D (stabilizer dispersion) | |
|---|---|
| Stabilizer (refer to table 2) | 2 parts |
| 10% aqueous solution of polyvinyl alcohol | 2.5 parts |
| Water | 1.5 parts |

Heat sensitive recording paper was prepared in the same manner as in Example 2 except for using the solution D processed in the attritor in place of the solution C.

COMPARATIVE EXAMPLE 23

| Solution E (developer dispersion) | |
|---|---|
| Bisphenol A | 6 parts |
| 10% aqueous solution of polyvinyl alcohol | 29.5 parts |
| Water | 5.5 parts |

Heat sensitive recording paper was prepared in the same manner as in Example 2 except for using the solution E processed in the attritor in place of the solution B.

COMPARATIVE EXAMPLE 24

Heat sensitive recording paper was prepared in the same manner as in Comparative Example 23 without using the solution C.

COMPARATIVE EXAMPLES 25–28

Heat-sensitive recording paper was prepared in the same manner as in Comparative Example 23 except for using the solution D in place of the solution C.

The results for the quality performance test of the heat-sensitive recording papers in above Example and Comparative Examples are shown in Table 2.

TABLE 2

| | | | Test Results | | | | | |
|---|---|---|---|---|---|---|---|---|
| | | | Oil resistance | | | White paper preservability | | |
| | Color developer | Stabilizer | Before treatment | After treatment | Residual rate (%) | Untreated | Humidity resistance | Thermal resistance |
| Example 2 | 4-Methyl-4'-hydroxy diphenylsulfone | Calcium monobenzyl phthalate | 1.17 | 1.10 | 94.0 | 0.06 | 0.07 | 0.09 |
| Comparative Example 18 | 4-Methyl-4'-hydroxy diphenylsulfone | No addition | 1.19 | 0.19 | 16.0 | 0.06 | 0.06 | 0.08 |
| Comparative Example 19 | 4-Methyl-4'-hydroxy diphenyl-sulfone | Zinc stearate | 1.18 | 0.20 | 16.9 | 0.06 | 0.06 | 0.09 |
| Comparative Example 20 | 4-Methyl-4'-hydroxy diphenylsulfone | Zinc terephthalate | 1.17 | 0.21 | 17.9 | 0.07 | 0.08 | 0.13 |
| Comparative Example 21 | 4-Methyl-4'-hydroxy diphenylsulfone | Calcium benzoate | 1.19 | 0.58 | 48.7 | 0.07 | 0.09 | 0.12 |
| Comparative Example 22 | 4-Methyl-4'-hydroxy diphenylsulfone | Calcium t-butylbenzoate | 1.17 | 0.63 | 53.8 | 0.07 | 0.10 | 0.14 |
| Comparative Example 23 | Bisphenol A | Calcium monobenzyl phthalate | 1.06 | 0.98 | 92.5 | 0.09 | 0.09 | 0.15 |
| Comparative Example 24 | " | No addition | 1.08 | 0.40 | 37.0 | 0.08 | 0.08 | 0.10 |
| Comparative Example 25 | " | Zinc stearate | 1.07 | 0.23 | 21.5 | 0.08 | 0.08 | 0.17 |
| Comparative Example 26 | " | Zinc terephthalate | 1.06 | 0.25 | 23.6 | 0.09 | 0.12 | 0.20 |
| Comparative Example 27 | " | Calcium benzoate | 1.06 | 0.63 | 59.4 | 0.09 | 0.11 | 0.19 |
| Comparative Example 28 | " | Calcium t-butylbenzoate | 1.08 | 0.66 | 61.1 | 0.09 | 0.12 | 0.21 |

Note (1): Oil resistance;
The density of a recorded image with an impressed voltage of 18.03 V and a pulse length of 3.2 milliseconds using the heat-sensitive facsimile KB-4800 made by Toshiba Corp. was measured with a Macbeth densitometer (using a RD-514 amber filter). The density thus measured was adopted as the density before treatment. On the other hand, the density after treatment with oil was measured in the following manner. First, castor oil was dropped in the colored part of printed letters. After 10 seconds, castor oil was lightly wiped up with a filter paper. After permitting to stand for 3 days at room temperature, the density of developed color was measured using the Macbeth densitometer. Residual rate was calculated from the following equation.

$$\text{Residual rate} = \frac{\text{Density of developed color after treatment with oil}}{\text{Density of developed color before treatment}} \times 100\ (\%)$$

Note (2): White paper preservability;
The density of the uncolored part was measured using the Macbeth densitometer.
Note (3): Humidity resistance;
Density of the image after permitting to stand for 24 hours under the circumstances of high humidity (90% RH) at 40° C.
Note (4): Thermal resistance;
Density of the image after permitting to stand for 24 hours under the circumstances of high temperature (60° C.) and dryness.

We claim:

1. A heat-sensitive recording sheet which comprises a support and a heat sensitive color-developing layer on at least one surface of said support, said heat-sensitive color layer containing a basic color-less dye and an organic developer as main components, characterized by comprising both calcium monobenzyl phthalate of the following general formula (III) as stabilizer and at least a compound selected from the group consisting of 4-isopropoxy-4'-hydroxy diphenylsulfone of the following general formula (I) and 4-methyl-4'-hydroxy diphenylsulfone of the following general formula (II) as said organic developer in said heat-sensitive coloring layer:

(I)

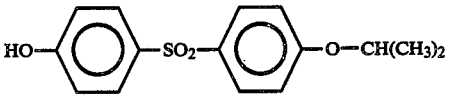

(II)

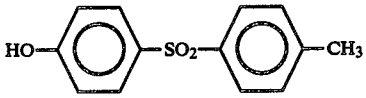

(III)

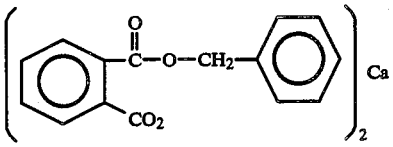

2. A heat-sensitive recording sheet according to claim 1, wherein said calcium monobenzyl phthalate is added in an amount ranging from 10 to 60 wt % with respect to said organic developer.

3. A heat-sensitive recording sheet according to claim 1, wherein said basic colorless dye is at least a member selected from the group consisting of triphenylmethane leuco dye, fluoran leuco dyes and azaphthalide leuco dye.

4. A heat-sensitive recording sheet according to claim 1 or 3, wherein said basic colorless dye is at least a compound selected from the group consisting of 3-diethylamino-6-methyl-7-anilinofluorane, 3-(n-cyclohexyl-n-methylamino)-6-methyl(-7-anilinofluorane, 3-(n-ethyl-n-isoamyl)amino-6-methyl-7-anilinofluorane, and 3-(4-diethylamino-2-ethoxyphenyl)-3-(1-ethyl-2-methylindole-3-yl)-4-azaphthalide.

5. A heat-sensitive recording sheet according to claim 1, wherein said color-developing layer comprises 3–12 parts of 4-isopropoxy-4'-hydroxy diphenylsulfone, 1–4 parts of calcium monobenzyl phthalate and 1–20 parts of the filler per one part of said colorless basic dye, and 10–25 parts of the binder for the total solid content.

6. A heat-sensitive recording sheet according to claim 1, wherein said color-developing layer comprises 3–12 parts of 4-methyl-4'-hydroxy diphenylsulfone, 3–12 parts of calcium monobenzyl phthalate and 1–20 parts of the filler per one part of said colorless basic dye, and 10–25 parts of the binder for the total solid content.

7. A heat-sensitive recording sheet according to claim 1, wherein said color-developing layer further comprises an additional sensitizer.

* * * * *